United States Patent [19]

Viola et al.

[11] Patent Number: 4,675,990

[45] Date of Patent: Jun. 30, 1987

[54] BLADE FUSE MANUFACTURING METHOD

[75] Inventors: Frank J. Viola, Uniondale; Erwin L. Schaub, Manhasset, both of N.Y.; Lawrence H. Burke, Oregon, Ill.

[73] Assignee: Parker-Hannifin Corporation, Cleveland, Ohio

[21] Appl. No.: 670,115

[22] Filed: Nov. 9, 1984

Related U.S. Application Data

[62] Division of Ser. No. 547,514, Oct. 31, 1983, Pat. No. 4,504,816.

[51] Int. Cl.[4] ..... H01H 69/02

[52] U.S. Cl. ..... 29/623; 219/80; 228/170

[58] Field of Search ..... 29/623; 228/170, 176, 228/179; 337/255-264

[56] References Cited

U.S. PATENT DOCUMENTS

| | | | |
|---|---|---|---|
| 3,436,711 | 4/1969 | Borzoni | 337/255 |
| 3,775,724 | 11/1973 | Mamrick et al. | 337/245 |
| 4,023,264 | 5/1977 | Schmidt, Jr. et al. | 29/623 |
| 4,099,320 | 7/1978 | Schmidt, Jr. et al. | 29/623 |
| 4,099,321 | 7/1978 | Aryamane | 29/623 |
| 4,099,322 | 7/1978 | Tait | 29/623 |

*Primary Examiner*—Percy W. Echols

*Attorney, Agent, or Firm*—Christopher H. Morgan

[57] ABSTRACT

A blade fuse includes parallel blades (12 and 14) secured in a body (16). A fusible link (42) welded to the blades is located in a cavity (20) of the body that is covered by a window (61). The blade fuses are assembled by blanking the fusible element from a ribbon (90) and translating it into a fuse subassembly (64). Tabs (50 and 52) secure the fusible element in the subassembly (64) until it is spot welded to blades 12 and 14. The window (61) is then blanked and translated to cover cavity (20) and secured by ultrasonic welding. A connector strip (76) is then blanked from between blades (12 and 14) to provide the blade fuse.

5 Claims, 10 Drawing Figures

BLADE FUSE MANUFACTURING METHOD

This application is a division of application Ser. No. 547,514, filed Oct. 31, 1983, now U.S. Pat. No. 4,504,816.

BACKGROUND OF THE INVENTION

1. Field of the Invention

The subject invention is directed to electrical fuses and, in particular, blade-type fuses as used in vehicular electrical systems.

2. Description of the Prior Art

As in other electrical systems, fuses have been used on vehicular electrical systems to protect the electrical circuits and to insure the safety of operators, passengers and mechanics. For many years, such fuses were of the type generally referred to as cartridge or cylinder fuses wherein a fuse element is housed in a transparent cylinder. The cylinder was closed by end caps that were soldered to the fuse element. The fuse was insertably maintained in a fuse block with the end caps acting as contacts for electrical connection to the respective circuit.

As vehicular electrical systems grew more sophisticated, the number of required fuses also grew. Since the cartridge fuse was somewhat bulky, it was found that a more compact fuse arrangement would be advantageous. The cartridge fuses were also subject to other disadvantages including that they were somewhat difficult to insert and remove from the fuse block and were subject to damage during insertion and removal. Generally a special tool was required for this purpose. Accordingly, there was a need for a fuse of a compact design that was more durable and could be easily inserted and removed from the fuse block.

In response to this need, blade type fuses such as described in U.S. Pat. No. 3,775,724 were developed and introduced. Generally, these fuses were comprised of two flat blades that were secured in a body. The fusible link was located inside the body and soldered to the two blades. Blade fuses were accepted and rapidly became popular because they were compact, durable and could be easily inserted and removed from the fuse block without special tools.

While blade fuses of the prior art were found to be an improvement over cartridge fuses, several disadvantages became apparent. For example, in prior cartridge fuses, the fusible link was made of a zinc alloy that was rolled to a thickness of selected gauge, depending upon the fuse rating. Because this zinc alloy could be rolled within close tolerances, it provided precise fuse links that were found to work well in cartridge fuses. Early blade fuses attempted to utilize similar fusible links of rolled zinc alloy. However, the manner of electrically connecting the rolled fusible links to the blades was a problem in producing commercial quantities of blade fuses.

Early blade fuses attempted to connect the fusible link to the blades by soldering in a manner similar to that of the cartridge fuses. However, soldering required a somewhat enlarged fuse body to accommodate the soldered areas. Also, the soldering techinque was relatively slow, requiring time for the solder to melt and resolidify. Moreover, the fusible link and the blades had to be mechanically held together during the soldering process. For example, in some designs as shown in U.S. Pat. No. 3,775,724, a mechanical interlock between the blades and the fuse link was used.

Another disadvantage of soldring the fusible link to the blades was that the solder connection sometimes interfered with proper operation of the fuse. Specifically, under overcurrent conditions, the solder in some blade fuse designs would melt before the fuse link itself would fail. This would temporarily interrupt the circuit but left the potential that the solder would resolidify in such a manner as to remake electrical contact between the blade and the fusible element, thus maintaining power to the circuit and concealing that the circuit had experienced an overcurrent condition.

Selecting a fusible link having a melting point lower than the melting point of the solder presented another difficulty. Specifically, the fuse elements were difficult to solder to the blades without melting the fuse element in the process.

To avoid these disadvantages, some blade type fuses avoided the problem of connecting the fusible link to the blades by forming the fusible link and the blades from a single piece of metal. An example is shown in U.S. Pat. No. 4,131,869. In these fuses, the fusible link was not rolled to a specified gauge, but was skived down from the same thickness as the blades. This technique was adequate for fuses of sufficiently high ampere ratings where the fusible link did not have to be skived too small. However, at smaller ampere ratings, the fusible link is thinner and more delicate so that it becomes increasingly difficult to skive the fusible link within acceptable tolerances.

In other blade fuses, the fusible link and blades were preassembled by connecting the fusible links to the blades with a heat weld before the blades were secured in the body. These fuses were somewhat difficult to make in that the fusible link and blade assembly had to be connected to the body without breaking the fusible link. Also, this resulted in a blade fuse wherein the body was not molded completely around the blades but left substantially one side of the blades and the fusible link itself uncovered by the body.

Accordingly, it was known that the rolled metal link used in cartridge fuses could be held to very close tolerances. However, no commercially successful mechanism existed in the prior art for rapidly and reliably assembling blade fuses with such relatively delicate links to provide a blade fuse in which the body secured and covered the blades such that the fusible link and blades were unexposed. Accordingly, there was a need for blade fuses with a rolled metal link including a commercially successful method of assembling such a fuse.

SUMMARY OF THE INVENTION

In accordance with the subject invention, a blade fuse includes two blades that are secured in parallel relationship by a body. One end of the blades extends from the body and is adapted for engagement with an electrical terminal block. The other end of the blades is exposed from the body and is adjacent the surface of the body that is disposed away from the terminal engaging ends. The body also includes an opening that leads to a cavity with the blades extending therethrough. A fusible link located within the cavity and transversely arranged between the blades is bonded to the blades by spot welds. A window is secured to the body at the opening and cooperates with the cavity walls to enclose the fuse link.

Preferably, the body is further provided with openings that are isolated from the cavity and that expose the side of the blades opposite from the side connected to the fusible link. Also preferably, the fusible link is provided with tabs that make an interference fit with the walls of the cavity and urge the fusible link toward the blades.

Also in accordance with the subject invention, the blade fuse herein disclosed is assembled by blanking a fuse link from a ribbon of rolled metal and translating the fuse link to a molded subassembly. The molded subassembly includes the fuse blades secured in a body that has an opening leading to a cavity. Preferably the fuse link is translated to the cavity of the body in the same stroke by which it is severed from the carrier strip of the ribbon. The fuse link is then bonded to the blades of the molded subassembly. Preferably, this is done by spot welding the fuse link to the blades. A window is then inserted into the opening of the molded subassembly leading to the cavity and bonded to the subassembly.

Also preferably, the blades of adjacent subassemblies are joined end-to-end such that the blades act as a carrier strip for the subassemblies during assembly of the fuse, with the blades of adjacent fuses being separated after the window is bonded in the opening.

Other details, object and advantages of the subject invention will become apparent from the following description of a presently preferred embodiment of a blade fuse and a presently preferred method for assembling the same.

BRIEF DESCRIPTION OF THE DRAWINGS

The accompanying drawings show a presently preferred embodiment of a blade fuse and illustrate a presently preferred method for assembling a blade fuse in accordance with the subject invention wherein.

DESCRIPTION OF THE PREFERRED EMBODIMENT

Figure 1A:
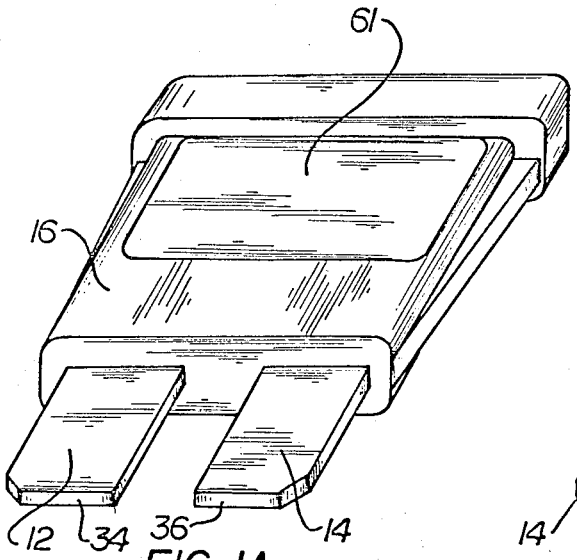
FIG. 1A is a projection of the window side of a blade fuse in accordance with the subject invention.
Figure 1B:
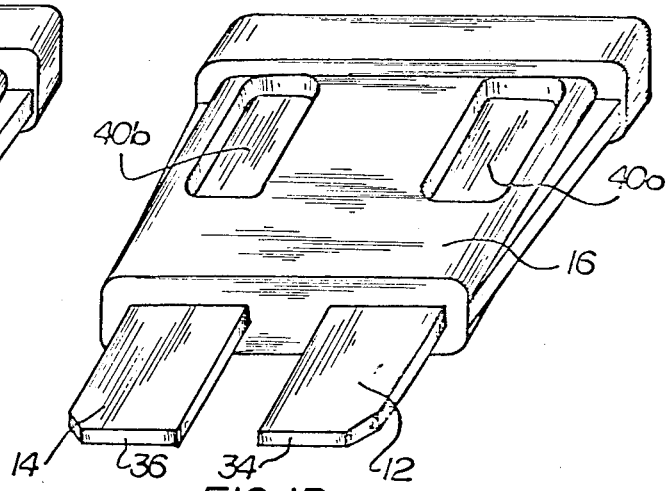
FIG. 1B is a projection of the opposite side of the blade fuse shown in FIG. 1A.

A presently preferred embodiment of a fuse in accordance with the subject invention is shown in FIGS. 1A and 1B. The fuse includes blades 12 and 14 that are secured in parallel arrangement by a body 16. As more specifically shown in FIGS. 6, 7 and 8, body 16 includes an opening 18 that leads to a cavity 20. Cavity 20 includes a bottom surface 22 and walls 24, 26, 28 and 30. Cavity 20 also includes a shoulder 32 adjacent the perimeter of opening 18 and a well 33 located at the central portion of bottom surface 22.

Ends 34 and 36 of blades 12 and 14 respectively extend from body 16 and are adapted for insertion in a conventional terminal block. Opposite ends 38 and 40 of blades 12 and 14 are located adjacent the surface of body 16 and are exposed from body 16. Blades 12 and 14 and cavity 20 are arranged such that blades 12 and 14 extend through cavity 20.

Figure 5:
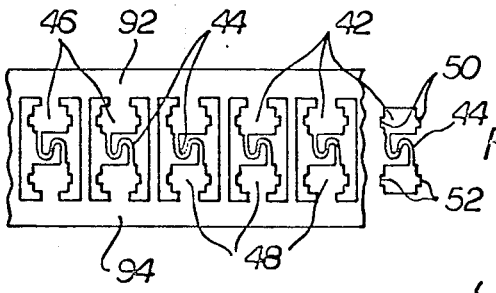
FIG. 5 is a plan view of the fusible links blanked out from a metal ribbon.
Figure 6:
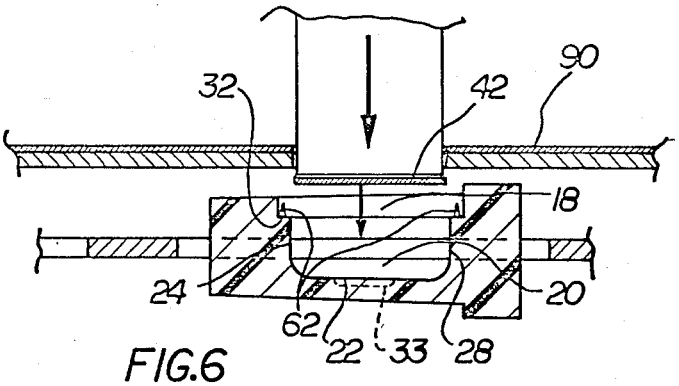
FIG. 6 is a detail elevation of the fuse link blanking and translating step illustrated in FIG. 4.
Figure 7:
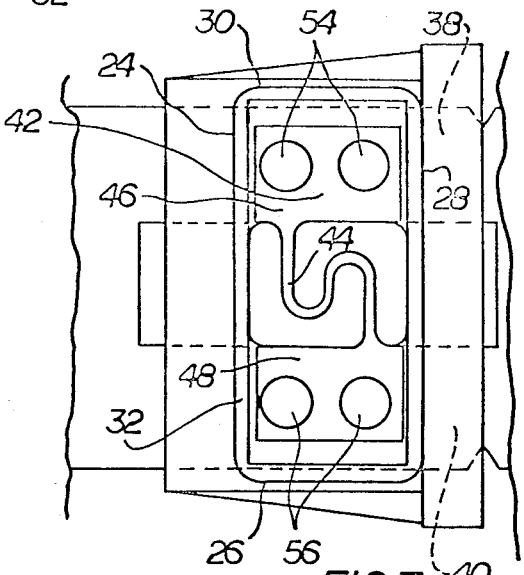
FIG. 7 is a plan view of the fuse subassembly with the fuse link welded to the blades therein.

As more particularly shown in FIGS. 5, 6 and 7, the subject fuse includes a fusible link 42. Fusible link 42 includes a fuse element 44 having heat sinks 46 and 48 located at opposite ends thereof. Heat sinks 46 and 48 are respectively provided with tabs 50 and 52. Tabs 50 and 52 cause fusible link 42 to form an interference fit within cavity 20 such that tabs 50 and 52 engage walls 24 and 28 of cavity 20 and urge fusible link 42 against the portion of blades 12 and 14 extending through cavity 20.

Body 16 is further provided with openings **40*a* and 40*b* that expose a portion of the side of blades 12 and 14 opposite from cavity 20. Openings 40*a* and 40*b* provide for dissipation of heat from blades 12 and 14 to the ambient air to avoid accumulation of heat and overtemperature conditions that could cause failure of the fuse at rated current. Also, as hereafter more fully explained, openings 40*a* and 40*b* provide access for electrodes to blades 12 and 14** during spot welding of the fusible link.

Figure 2:
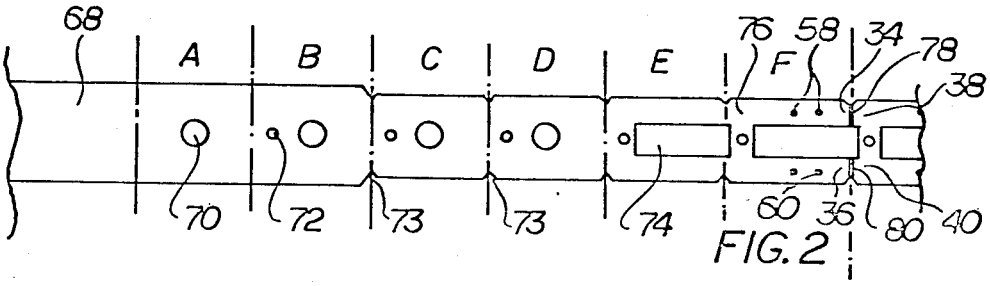
FIG. 2 is a plan view of the blades at each stage of progression through a stamping machine.
Figure 3:
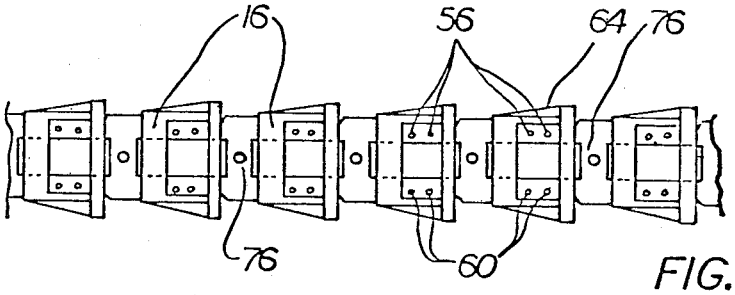
FIG. 3 is a plan view of a fuse subassembly with the final blades of FIG. 2 further incorporating molded bodies.

Fusible link 42 is bonded to blades 12 and 14 in cavity 20 by spot welds 54 and 56. As best shown in FIGS. 2 and 3, it is preferred that blades 12 and 14 are provided with raised areas 58 and 60 corresponding to respective spot welds 54 and 56. The raised surfaces of areas 58 and 60 concentrate the welds between the fusible link and the blades at those areas to produce a stronger, more conductive weld for a given weld time. Most preferably, spot welds 54 and 56 each comprise a plurality of individual welds, each of which are of larger cross-sectioned area and higher conductivity than fuse element 44. In this way, parallel conductive paths are provided between fusible link 42 and blades 12 and 14, providing redundancy for this connection.

Figure 8:
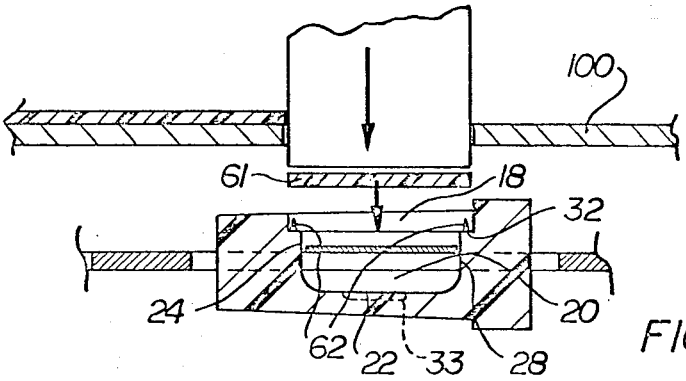
FIG. 8 is a detail elevation of the window blanking and translating step illustrated in FIG. 4.

As best shown in FIGS. 1 and 8, the subject fuse also includes a window 61 that is bonded to body 16 at shoulder 32. Window 61 can be bonded by ultraviolet curing adhesives or dielectric heat sealing techniques. However, it is preferred that the bonding be accomplished by ultrasonic welding. In the preferred embodiment, body 16 includes cones 62 that are located on shoulder 32 before window 61 is bonded to body 16. During the ultrasonic welding process, the ultrasonic energy tends to concentrate at the apex of these cones to melt the cones and weld the window to shoulder 32.

Figure 4:
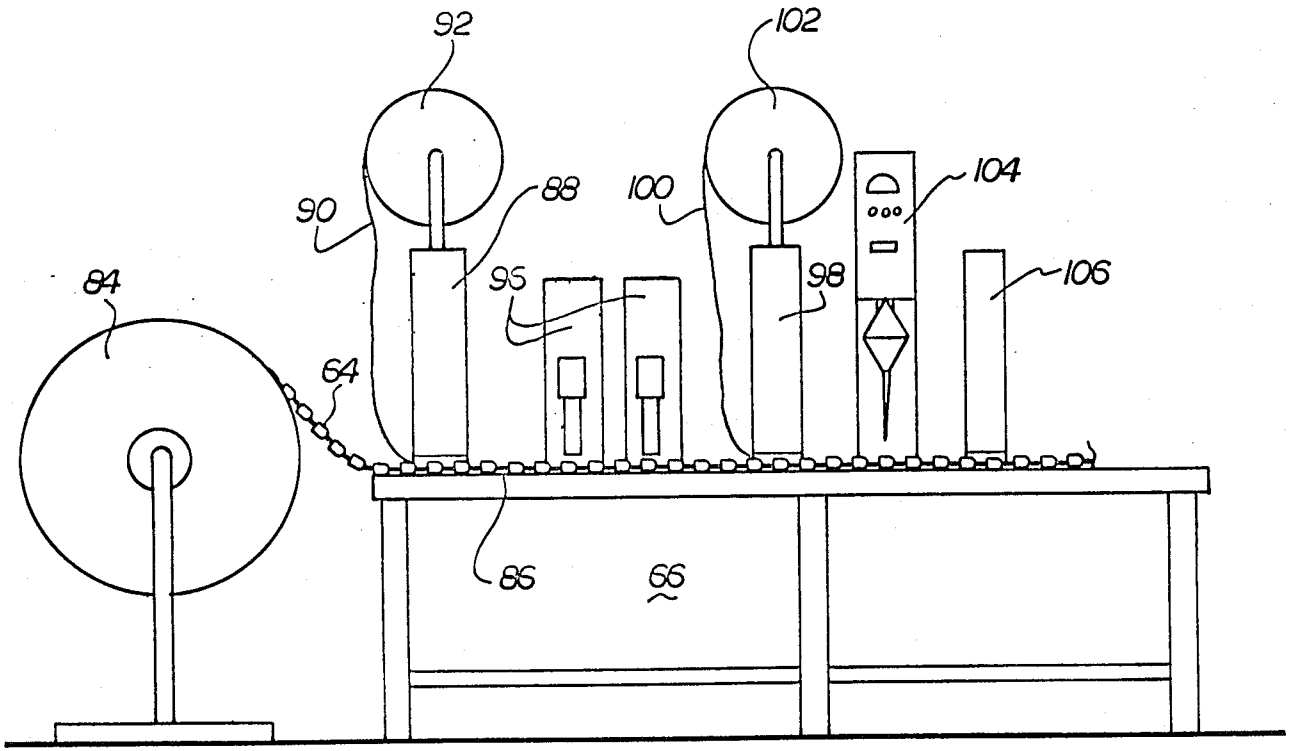
FIG. 4 illustrates an automized line for assembling the blade fuse shown in FIGS. 1A and 1B.

The fuse herein described provides a blade fuse that is compact and durable, and that can be efficiently manufactured on a commercial scale, even for low ampere ratings. The preferred method of assembling the fuse is further described in connection with FIGS. 2–9. FIG. 4 illustrates the preferred method of assembly wherein a roll of fuse subassemblies 64 is provided to an automated assembly line 66. The development of subassemblies 64 is more particularly shown in FIGS. 2 and 3.

FIG. 2 illustrates the progression of a zinc alloy strip 68 as it passes through a six-stage die. At stage A, a hole 70 is stamped in band 68 and at stage B a smaller guide hole 72 is stamped adjacent hole 70. At stages C and D the edges of band 68 are trimmed and notches 73 are provided. At stage E, center hole 70 is expanded to rectangular hole 74 to define blades 12 and 14 connected by a connector strip 76 that is transversely positioned between blades 12 and 14. Connector strip 76 and hole 70 provide a means for indexing the subassemblies through the stages of line 66. At stage F, raised areas 58 and 60 are provided in blades 12 and 14 respectively and the blades are scored at lines 78 and 80 to define blade ends 34 and 36 of one subassembly and blade ends 38 and 40 of the adjacent subassembly. The blade assemblies could be separated at this point. However, it is preferred that they be maintained in a single strip. By defining the blade assemblies from strip 68 in end-to-end relationship, blades 12 and 14 serve as the carrier strip for the subassemblies.

If it is desired to provide a blade fuse with tin plated blades, the plating is performed on the blade assemblies in accordance with conventional plating techniques. The blade assemblies are then fed to an injection molding machine which molds bodies 16 to each of the blade assemblies to produce subassemblies 64 shown in FIG. 3. Subassemblies 64 are then recoiled and ready to be provided to line 66 in FIG. 4.

Referring to FIG. 4, subassemblies 64 are provided from coil 84 to a conveyor line 86 where pins of the conveyor line engage holes 70 in the connector strip 76 of the subassemblies to control advance of the subassemblies along the line.

The first station on line 66 is punch press 88. Punch press 88 is provided with subassemblies 64 and metal ribbon 90 of rolled zinc alloy supplied from coil 92. As illustrated in FIGS. 5 and 6, punch press 8 is provided with a two stage die such that a fusible link 42 is blanked from strip 90 in one stroke and translated into cavity 20 of body 16 in a second stroke. After the first stroke, fusible links 42 are secured to carrier strips 92 and 94. On the second stroke, fusible links 42 are severed from carrier strip 92 and 94 and translated into cavity 20 in a single stroke. Thus, fusible link 42 is inserted into cavity 20 after molding body 16 around blades 12 and 14 so that handling of fusible link 42 is limited, improving both the speed and reliability of the process.

As previously mentioned, tabs 50 and 52 form an interference fit in cavity 20. In cavity 20, tabs 50 and 52 are bent out of the major plane of fusible link 42 with the distal ends of the tabs 50 and 52 projecting away from cavity 20 and toward the surface of body 16 to engage walls 24, 26, 28 and 30. In this manner, tabs 50 and 52 secure fusible link 42 in cavity 20 and urge the fusible link against blades 12 and 14 until subassembly 64 and fusible link 42 are advanced to spot welder 96 where the fusible link is welded to the blades. Since tabs 50 and 52 urge fusible links against blades, this also contributes to the speed and integrity of the spot welds 54 and 56.

At spot welder 96, electrodes are placed through opening 18 to contact fusible link 42 at an area opposite from raised areas 56 and 58 of blades 12 and 14. Also, electrodes are placed through openings **40*a* and 40*b* to contact blades 12 and 14 adjacent raised areas 56 and 58. Fusible link 42 is then welded to blades 12 and 14. Thereafter, subassemblies 64 with fusible links 42 welded thereto are advanced to press 98**.

Press 98 is supplied with a plastic strip 100 from web 102. As shown in FIG. 8 windows 61 are blanked from plastic strip 100 in a single stroke of press 98 and translated into opening 18 of body 16 to rest on the apices of cones 62. Subassemblies 64 bearing windows 61 are then advanced to the next station on line 66, an ultrasonic welder 104.

Figure 9:
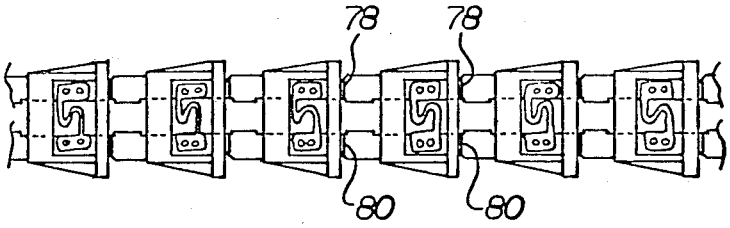
FIG. 9 is a plan view of the assembled blade fuses after the blade connector strip has been blanked out.

Ultrasonic welder 104 melts cones 62 to bond windows 61 to body 16. After windows 61 are welded to body 16 at ultrasonic welder 104, the subassemblies are advanced to the last station illustrated in FIG. 4, press 106. At press 106, connector strip 76 is blanked from between blades 12 and 14 to form a strip of completed fuses as shown in FIG. 9.

Thereafter, the strip of completed fuses is scored at lines 78 and 80 and the separate fuses broken apart, marked and packaged in accordance with conventional techniques.

While a presently preferred embodiment of the subject blade fuse has been shown and described and a presently preferred method of assembling the same has been illustrated in accordance with the subject invention, the invention is not limited thereto but can be otherwise variously embodied within the scope of the following claims.

We claim:

1. A method for assembling blade fuses, said method comprising:

blanking a fuse link connected to a carrier strip from a ribbon of rolled metal and translating the fuse link to a molded subassembly as the fuse link is severed from the carrier strip;

bonding the fuse link to the molded subassembly;

blanking a window from a strip of material and translating the window into an opening in the molded subassembly; and bonding the window to the molded subassembly to produce a fuse.

2. The method of claim 1 wherein the window is blanked from a strip by a punch and received in the opening of the molded subassembly in one stroke of the punch.

3. The method of claim 1 wherein the blades of the molded subassemblies are connected by a connector strip transversely positioned between the blades and provide a means for indexing the subassemblies.

4. The method of claims 1, 2 or 3, wherein the blades of adjacent subassemblies are joined end-to-end such that the blades act as a carrier strip for the subassemblies, said method further comprising:

separating the blades of adjacent fuses after the windows are bonded to the molded subassemblies.

5. A method for assembling blade fuses, said method comprising:

blanking a fuse link connected to a carrier strip from a ribbon of rolled metal and translating the fuse link to a molded subassembly;

welding the fuse link to the molded subassembly;

blanking a window from a strip of material and translating the window into an opening in the molded subassembly; and bonding the window to the molded subassembly.

* * * * *